United States Patent [19]

Johnson, Jr. et al.

[11] 4,235,159

[45] Nov. 25, 1980

[54] MACHINE FOR MANUFACTURE OF HIGH STRENGTH SHIPPING CARTONS

[75] Inventors: A. David Johnson, Jr., Wayne; George E. Ginther, Sr., King of Prussia; Joseph L. Bachman, Wayne, all of Pa.

[73] Assignee: Wayne Automation Corporation, King of Prussia, Pa.

[21] Appl. No.: 953,350

[22] Filed: Oct. 23, 1978

[51] Int. Cl.[3] ..... B31B 11/02; B31B 11/26

[52] U.S. Cl. ..... 493/309; 493/90; 493/130; 493/334

[58] Field of Search ..... 93/37 SP, 37 R, 38, 93/36.01

[56] References Cited

U.S. PATENT DOCUMENTS

| | | | |
|---|---|---|---|
| 2,623,442 | 12/1952 | Thaxton | 93/37 R |
| 2,879,700 | 3/1959 | Richardson et al. | 93/37 R |
| 3,134,308 | 5/1964 | Ali-Oglu | 93/37 SP |
| 3,350,836 | 11/1967 | Dillon et al. | 93/37 R X |
| 3,473,447 | 10/1969 | Ullman et al. | 93/37 SP X |
| 3,605,572 | 9/1971 | Derderian | 93/37 R |
| 3,621,765 | 11/1971 | Sootheran et al. | 93/37 R |
| 3,626,818 | 12/1971 | Anson | 93/37 R |
| 3,803,993 | 4/1974 | Graham | 93/37 R X |
| 4,015,516 | 4/1977 | Graham | 93/36.01 X |
| 4,154,148 | 5/1979 | Weremiczyk et al. | 93/37 SP |

*Primary Examiner*—Robert D. Baldwin
*Assistant Examiner*—J. Reed Batten, Jr.
*Attorney, Agent, or Firm*—Frederick J. Olsson

[57] ABSTRACT

Dividers and cartons are intermittently fed into the machine which automatically assembles the same by inserting one or more dividers into the carton and gluing tabs on the dividers to opposite panels of the carton. The machine has a magazine to feed in the dividers, a carton transporter to feed in the cartons, die means to bend edges of the divider to form the tabs, means to apply glue to the tabs, means to develop bonding pressure between tabs and panels together with a divider transporter. The divider transporter picks-off a divider from the magazine, deposits it in the die means for tab forming and then moves the formed divider into a carton while the tabs are sprayed with glue and then pressure bonded to opposite carton panels.

15 Claims, 26 Drawing Figures

MACHINE FOR MANUFACTURE OF HIGH STRENGTH SHIPPING CARTONS

This invention relates to the shipping carton art and in particular relates to a high speed machine for making high strength shipping cartons by taking a conventional four-panel carton and inserting one or more dividers into the carton and gluing or adhesively joining the dividers and carton together.

The machine is especially adapted to carry out the methods disclosed in co-pending application Ser. No. 870,467 filed Jan. 18, 1978 and entitled *HIGH STRENGTH SHIPPING CARTON.*

The primary object of the invention is to provide a reliable, straight forward, relatively inexpensive machine which can rapidly produce high strength cartons of the kind mentioned, for example in the order of 25 cartons per minute.

The invention contemplates a machine wherein four-panel cartons and flat dividers are fed into the machine which automatically assembles the same by inserting one or more dividers into a carton and gluing tabs on the divider to opposite side panels.

The operation separates into four functional stations, namely: a Return Station where the components are re-set for another cycle, A Pick-Off Station wherein a divider is picked-off or stripped out of a magazine; a Tab Forming Station wherein a divider is received from the Pick-Off Station and worked in a die to form tabs; and an Insert Station wherein a carton is positioned to receive a tab-formed divider from the forming die and wherein the tabs and carton side panels are glued or adhesively secured together and then the assembled carton/divider moved out of the machine.

The various structural and operational features of the machine will be apparent from the description below taken in conjunction with the following drawings wherein.

Figure 5A:
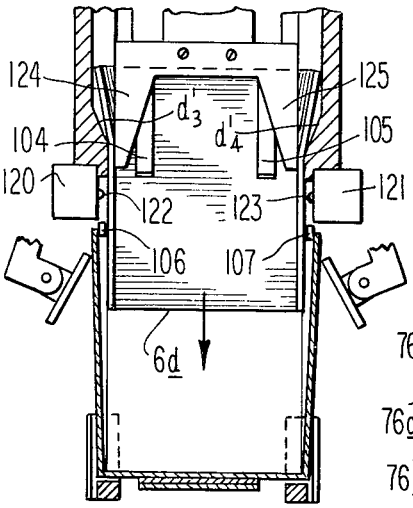
FIG. 5 is a reduced-size fragmentary view of machine components of FIG. 4 illustrating the position of components while a divider is being inserted into a four panel carton.
Figure 5:
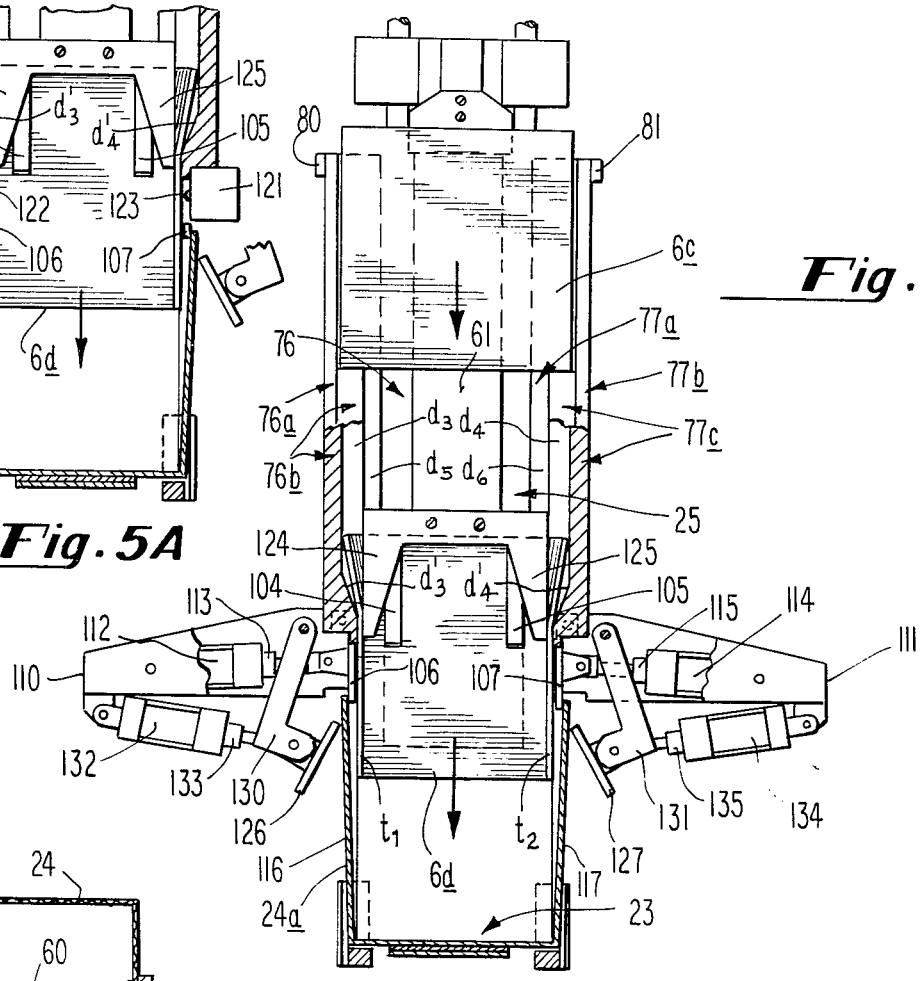
Figure 6:
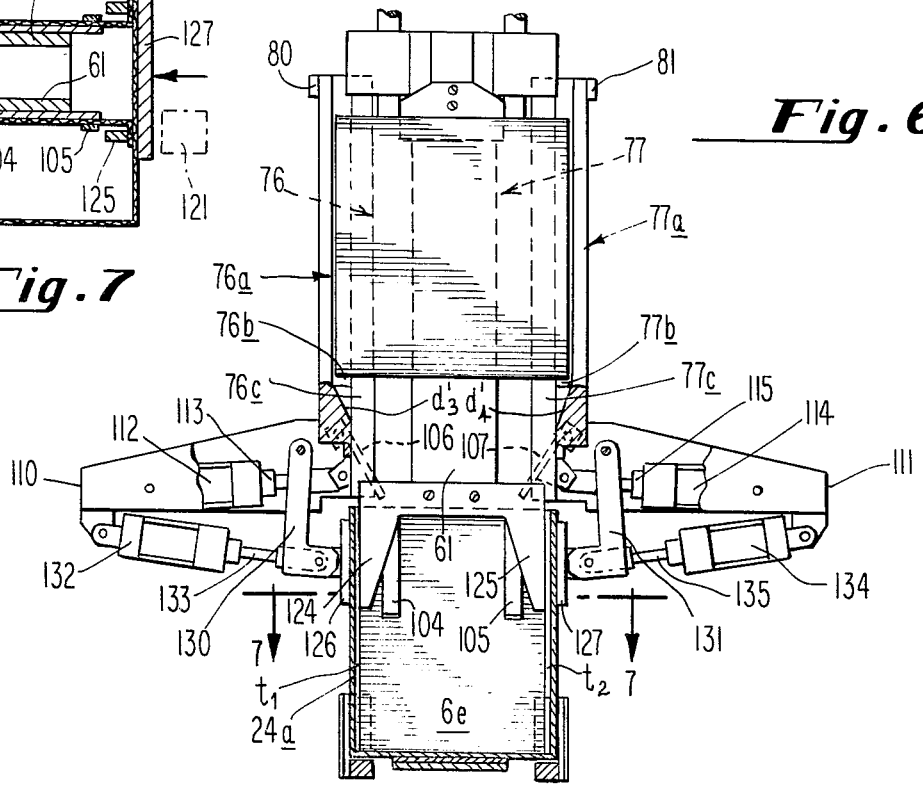

FIG. 5-A is a fragmentary view of certain components shown in the bottom of FIG. 5 with some components omitted to illustrate the location of the adhesive applying mechanism;

FIG. 6 is a view similar to FIG. 5 illustrating the position of certain machine components when a divider is fully inserted and pressure is applied to properly adhere the tabs and the panels.

Figure 1:
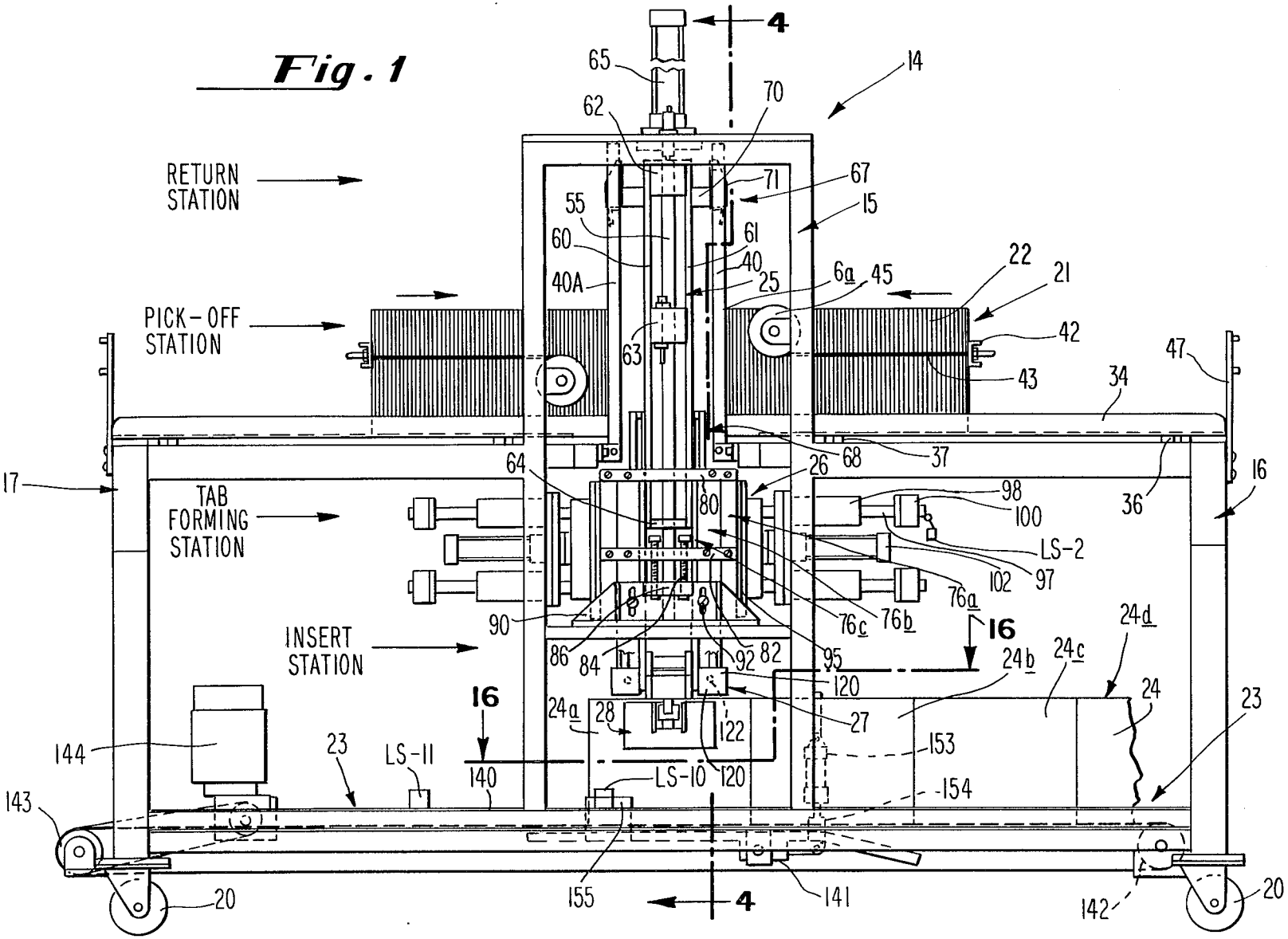
FIG. 1 is a front elevational view of the machine with the Return, Pick-Off, Tab Forming, and Insert Station areas being indicated by the arrows.
Figure 4:
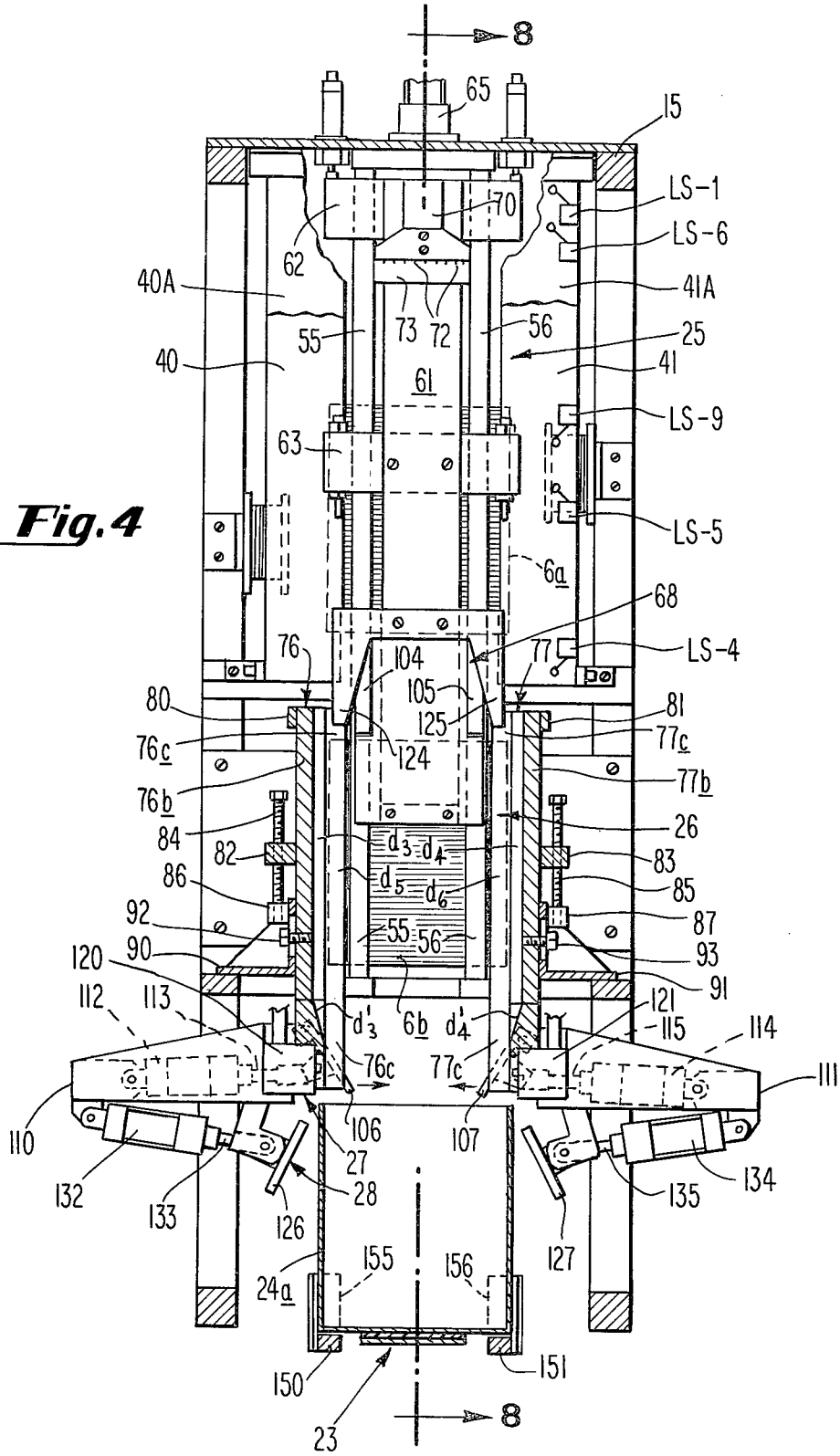
FIG. 4 is a side elevational view partially in section taken along the lines 4—4 of FIG. 1, the components being in the Return Station condition.
Figure 7:
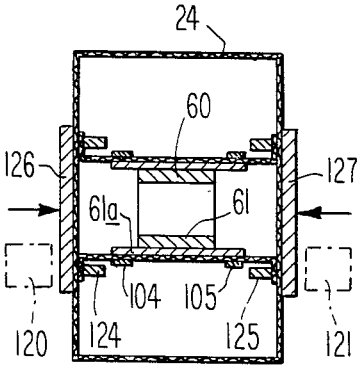
Figure 8:
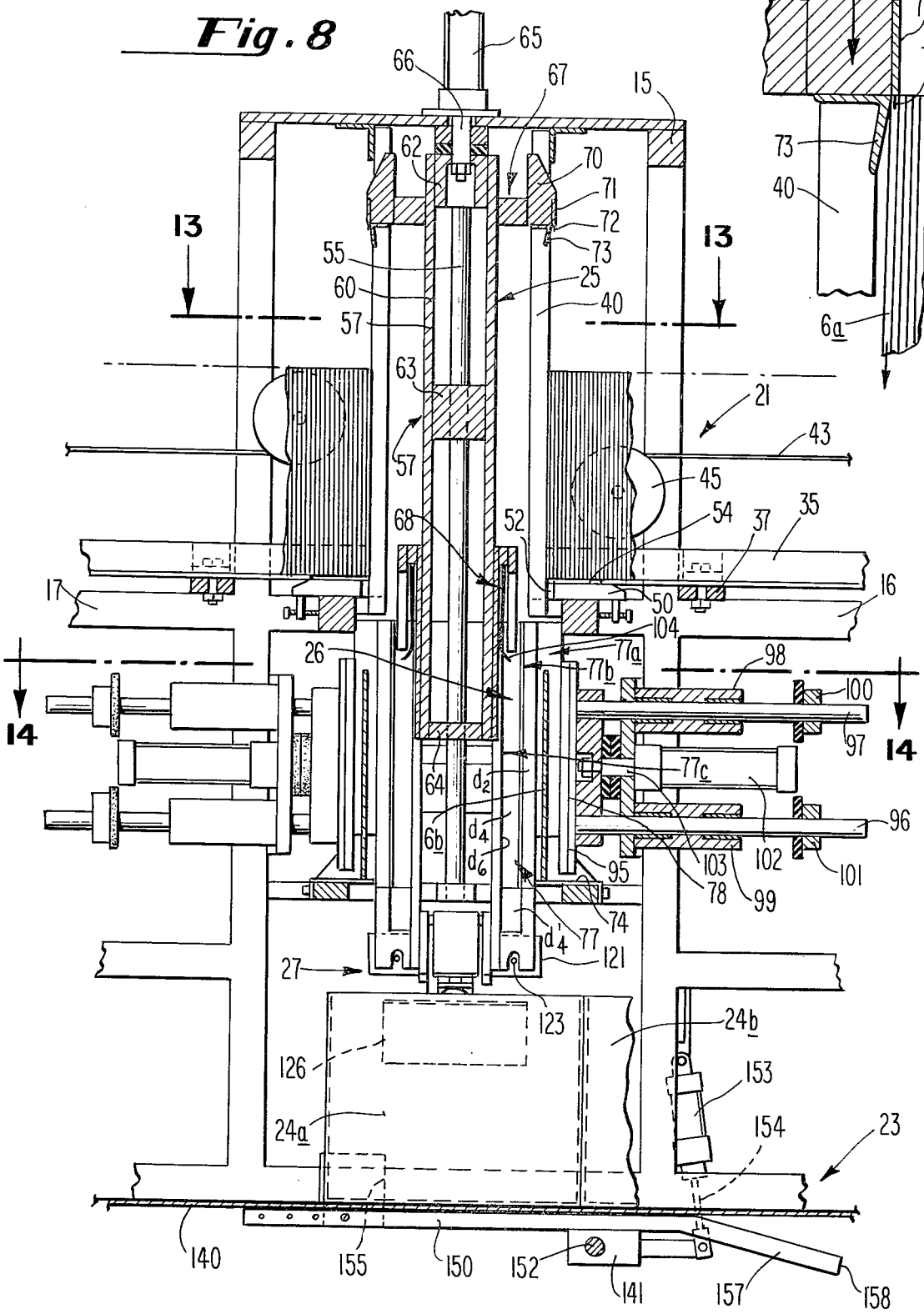
Figure 11:
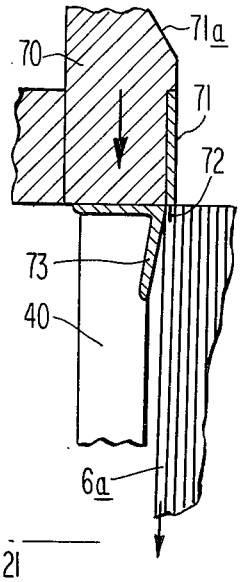
Figure 9:
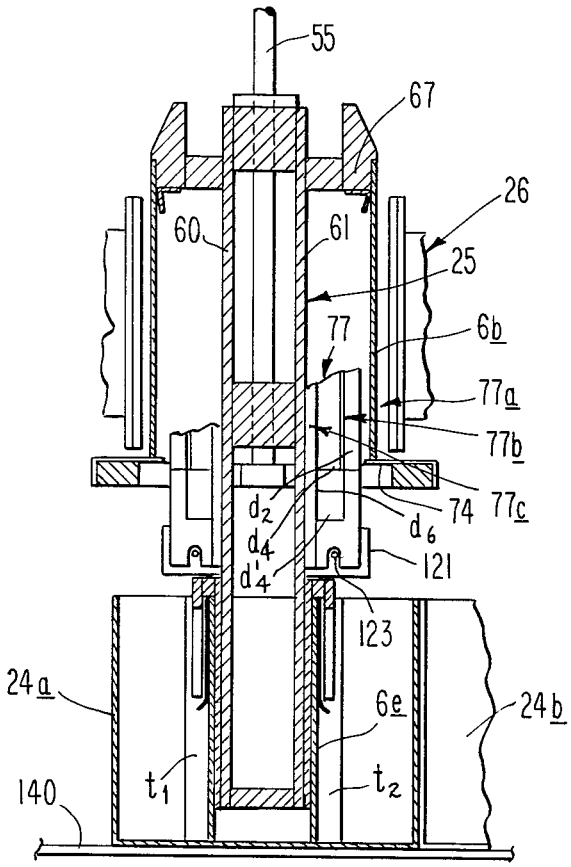
Figure 10:
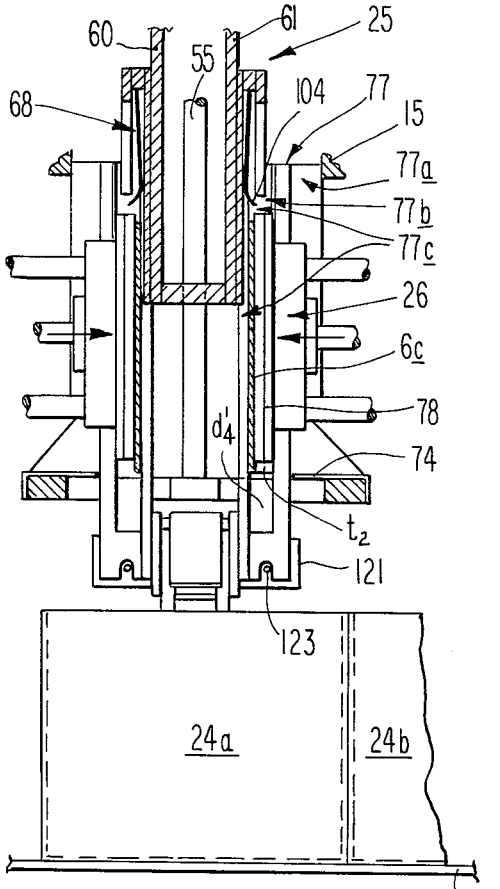
Figure 12:
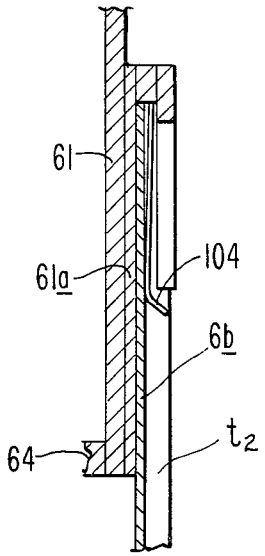
Figure 20:
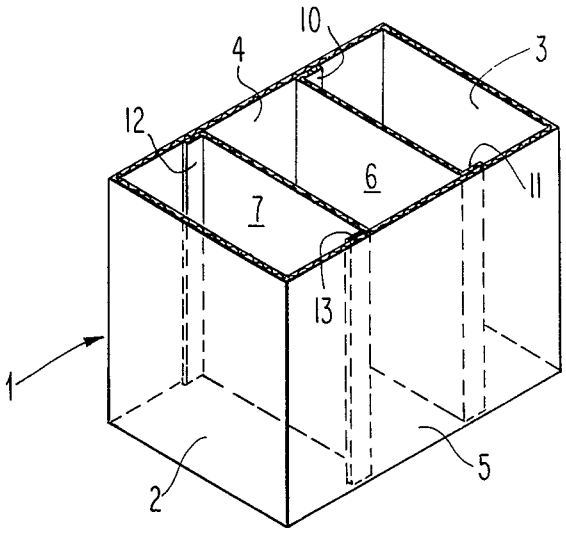
Figure 13:
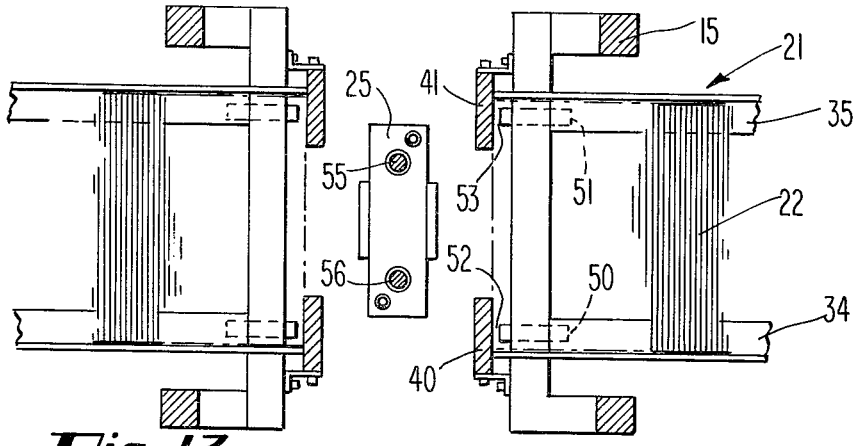
Figure 14:
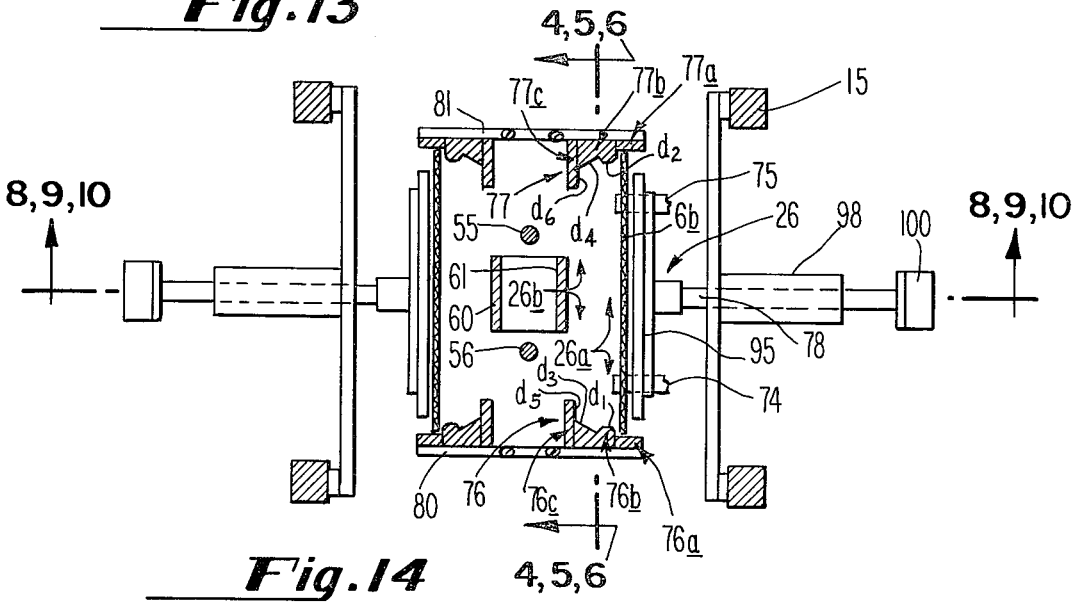
Figure 15:
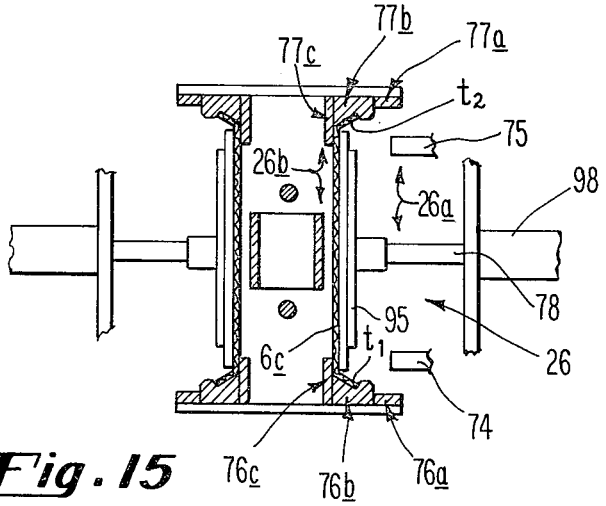
Figure 16:
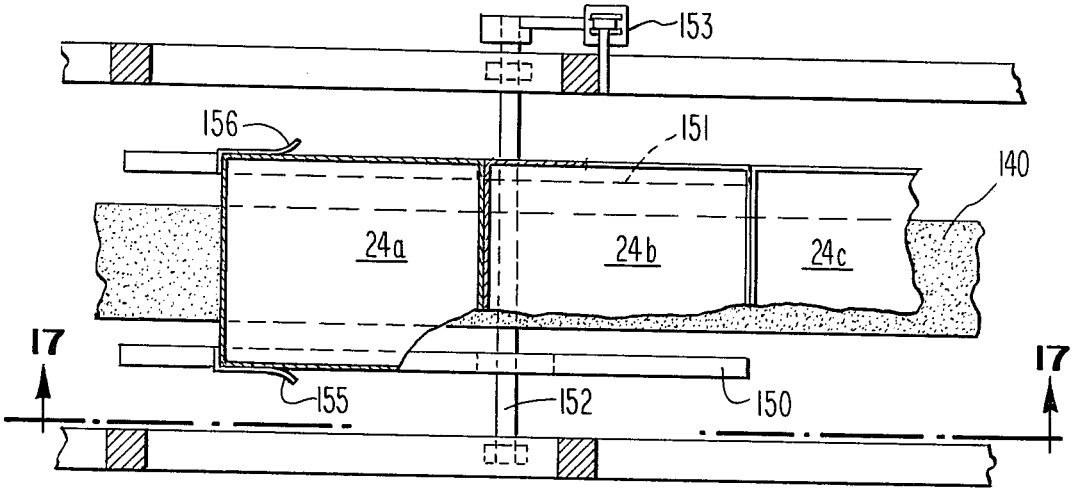
Figure 17:
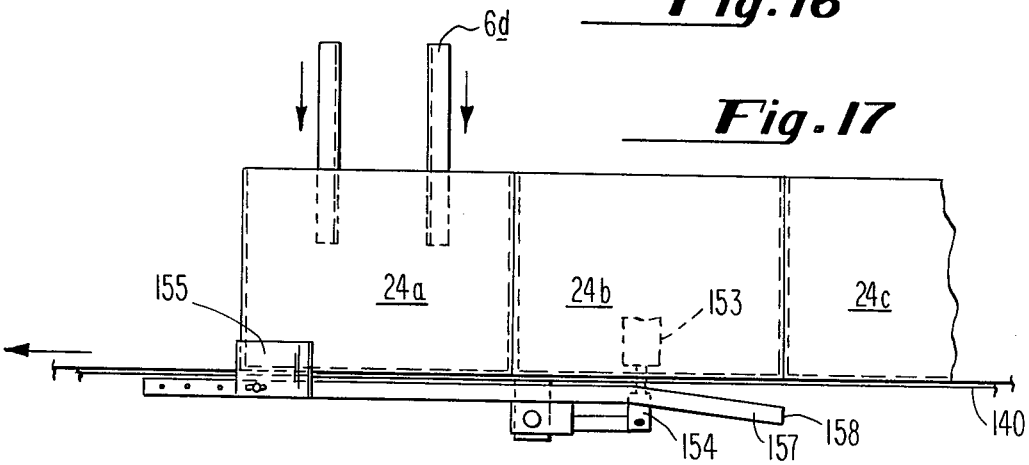
Figure 18:
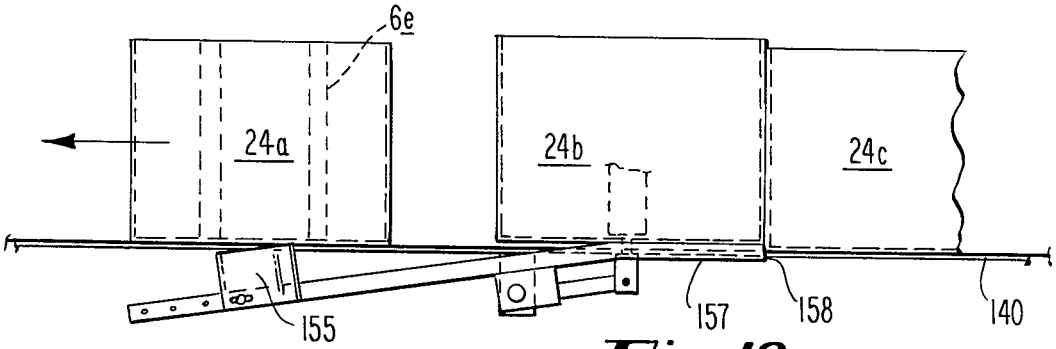
Figure 19:
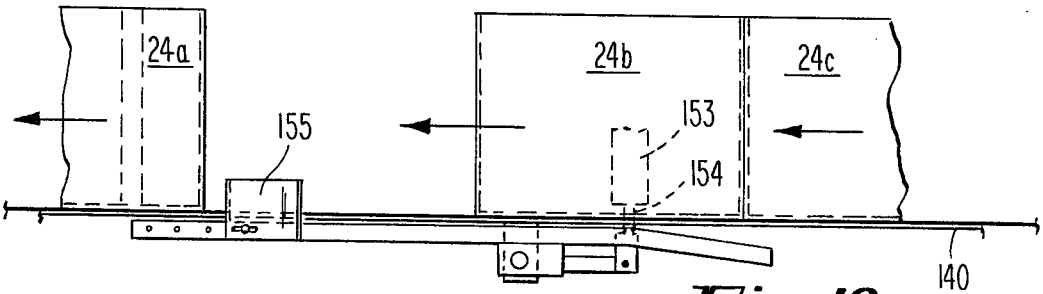

FIG. 7 is a plan sectional view taken along the lines 7—7 of FIG. 6 illustrating the pressure applying operation;

FIG. 8 is a front elevational view partially in section taken along the lines 8—8 of FIG. 4, the components being in the Return Station condition; FIG. 9 is a view similar to FIG. 8 illustrating the position of certain machine components at the time a divider from the magazine has been deposited in the Tab-Forming Station and a tab-formed divider has been inserted into the carton;

FIG. 10 is a reduced size fragmentary view of machine components of FIG. 4 showing the position of the components when a divider in the Tab-Forming Station has been formed with tabs;

FIG. 11 is a fragmentary view of the mechanism for stripping or picking-off a divider from the magazine;

FIG. 12 is a fragmentary view illustrating a gripping means for moving a divider from the Tab-Forming Station into the Insert Station;

FIG. 13 is a fragmentary plan view partially in section taken along the lines 13—13 of FIG. 8 and particularly illustrating the divider Pick-off Station;

FIG. 14 is a fragmentary plan view partially in section taken along the lines 14—14 of FIG. 8 and particularly illustrating the divider as positioned in the receiving section of the tab forming die means;

FIG. 15 is a view similar to FIG. 14 and illustrating the tab forming operation;

FIG. 16 is a fragmentary plan view partially in section taken along the lines 16—16 of FIG. 1 and illustrating a carton positioner/release mechanism;

FIG. 17 is a elevational view taken along the lines 17—17 of FIG. 16;

FIG. 18 is a view similar to FIG. 17 showing how a carton/divider assembly is released for removal from the machine;

FIG. 19 is a view similar to FIG. 18 illustrating how a new carton is brought up for the insert operation; and FIG. 20 is a perspective view of a carton/divider assembly.

Figure 21:
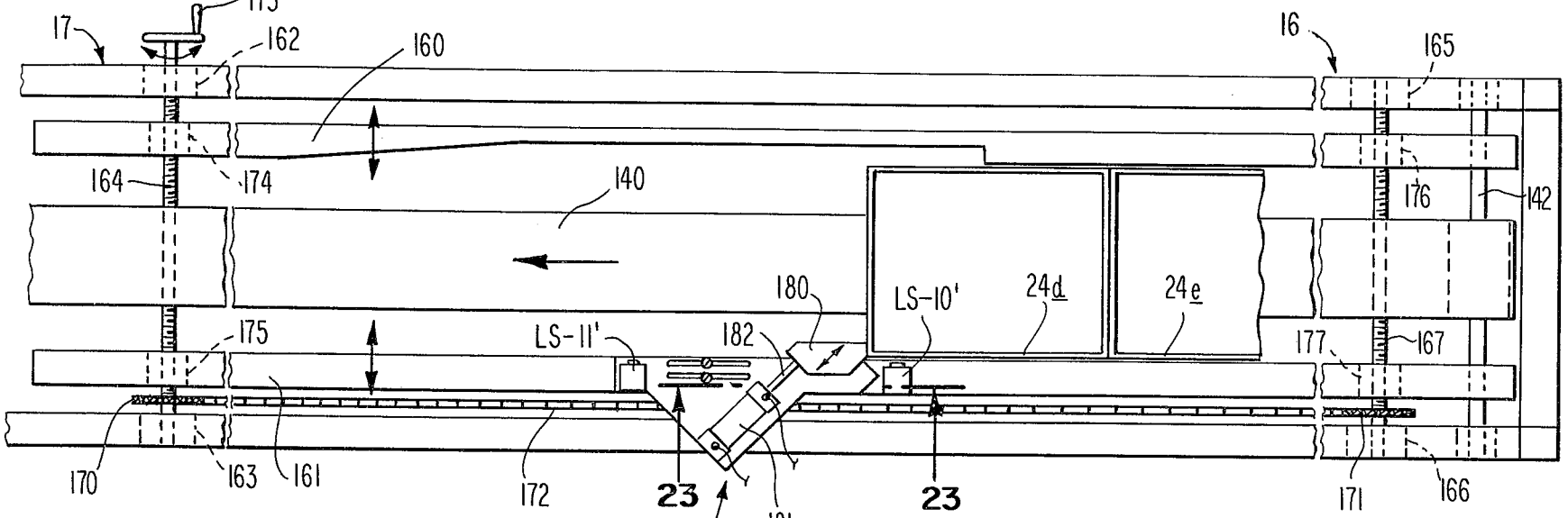
Figure 22:
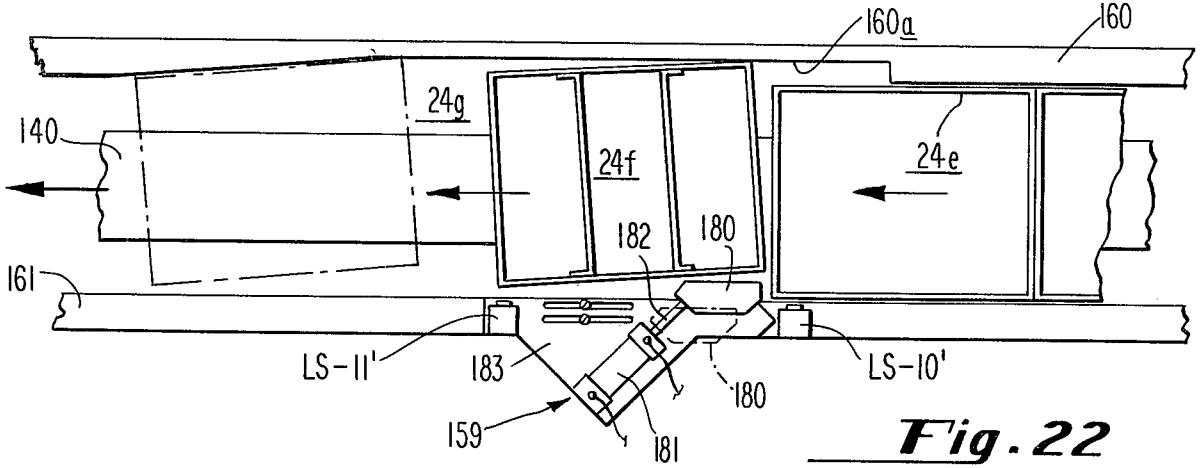
Figure 23:
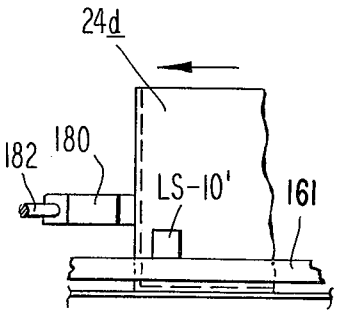
Figure 25:
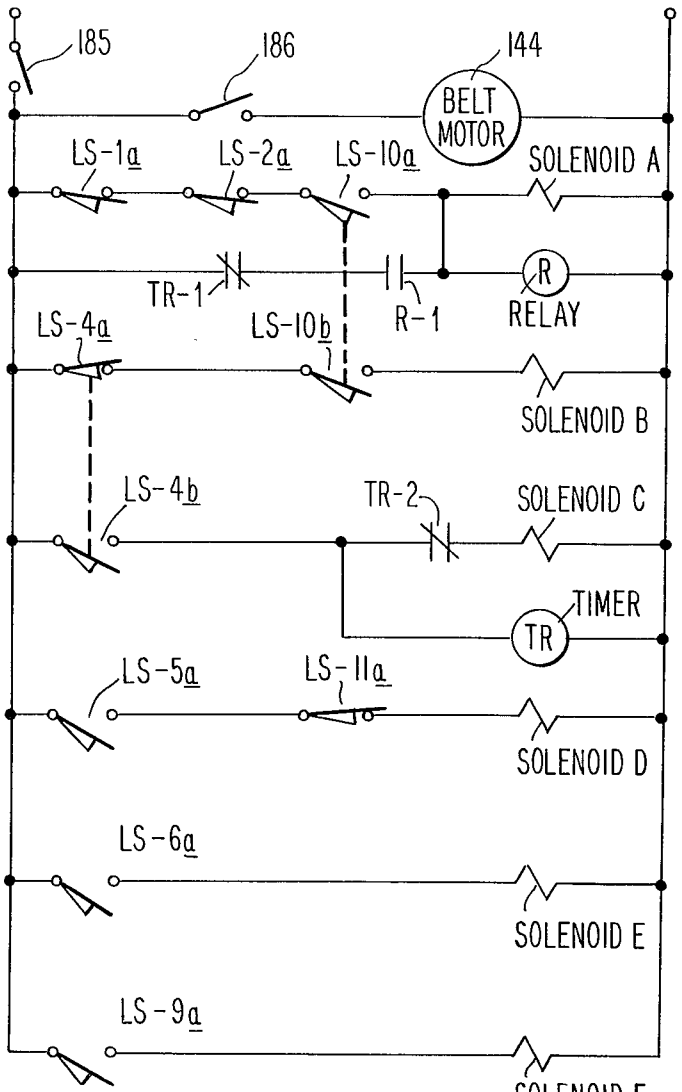
Figure 24:
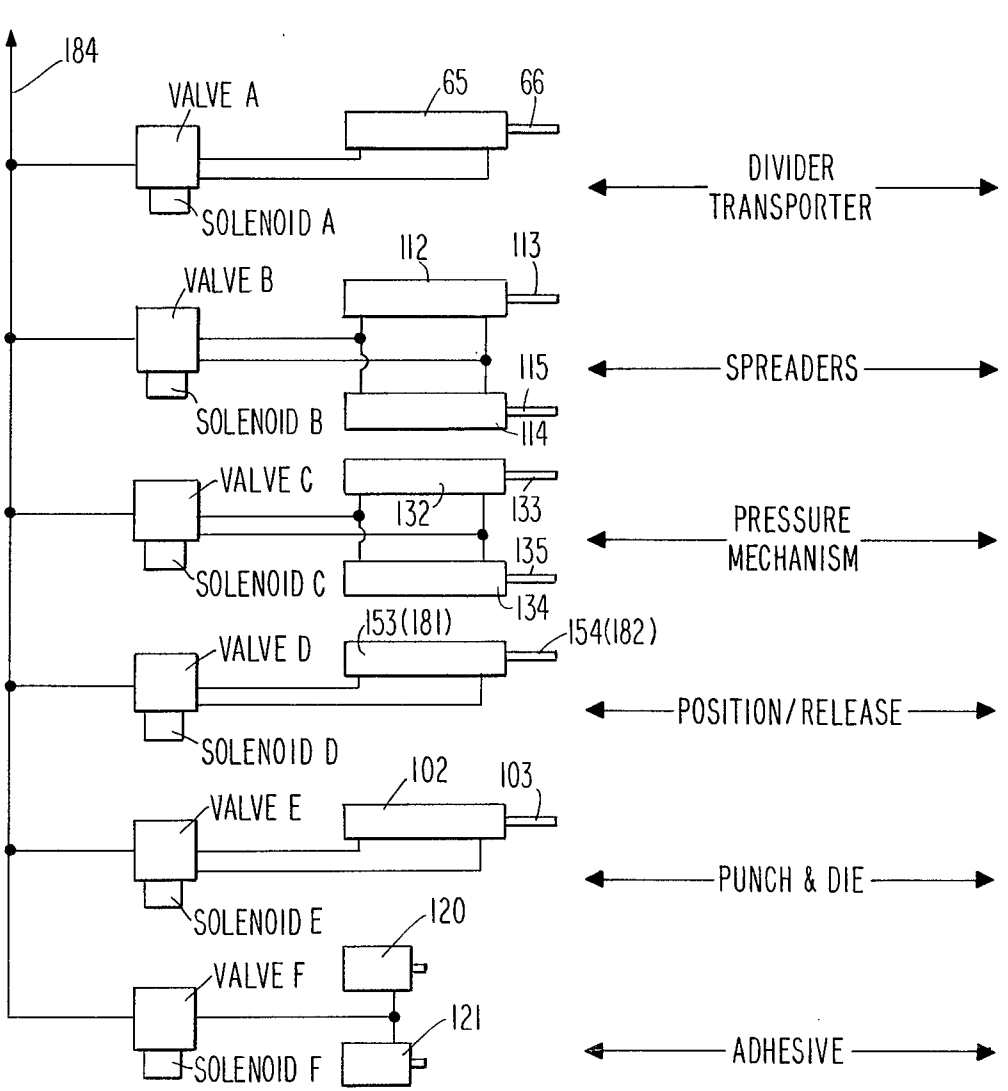

FIG. 21 is a fragmentary plan view illustrating another embodiment of a carton positioner/release mechanism;

FIG. 22 is a plan view showing components of FIG. 21 in position to release a carton/divider assembly;

FIG. 23 is a elevational view taken along the lines 23—23 of FIG. 21;

FIG. 24 is a diagrammatic view representing pneumatic control means for the machine; and FIG. 25 is a diagrammatic view representing electrical control means for the machine.

GENERAL

The terms "carton" and "divider" are used herein in the same sense as expressed in Application Ser. No. 870,467. The machine shown herein is adapted for a four-panel carton without top flaps. When top flap cartons are to be employed the machine components are arranged to accommodate the upwardly extending flaps.

Referring to FIG. 20, a typical four panel carton of the kind in question (without top flaps) is illustrated at 1. The carton has short panels 2 and 3, long panels 4 and 5, and bottom flaps not shown. The dividers 6 and 7 are joined to the long panels 4 and 5 respectively by tabs 10/11 and 12/13.

The machine herein is designed to simultaneously insert two dividers in a carton and thus the opposite sides of the machine are structurally and functionally mirror images of one another. If a single insert is to be employed with a carton, only one side of the machine is used. The machine is arranged so that appropriate adjustments can be made on the components.

For ease of description, the material which follows will focus on the right hand side of the machine. Where it may be necessary to identify corresponding parts of the left hand side of the machine the same numerals with a letter will be used.

MAJOR COMPONENTS

Figure 2:
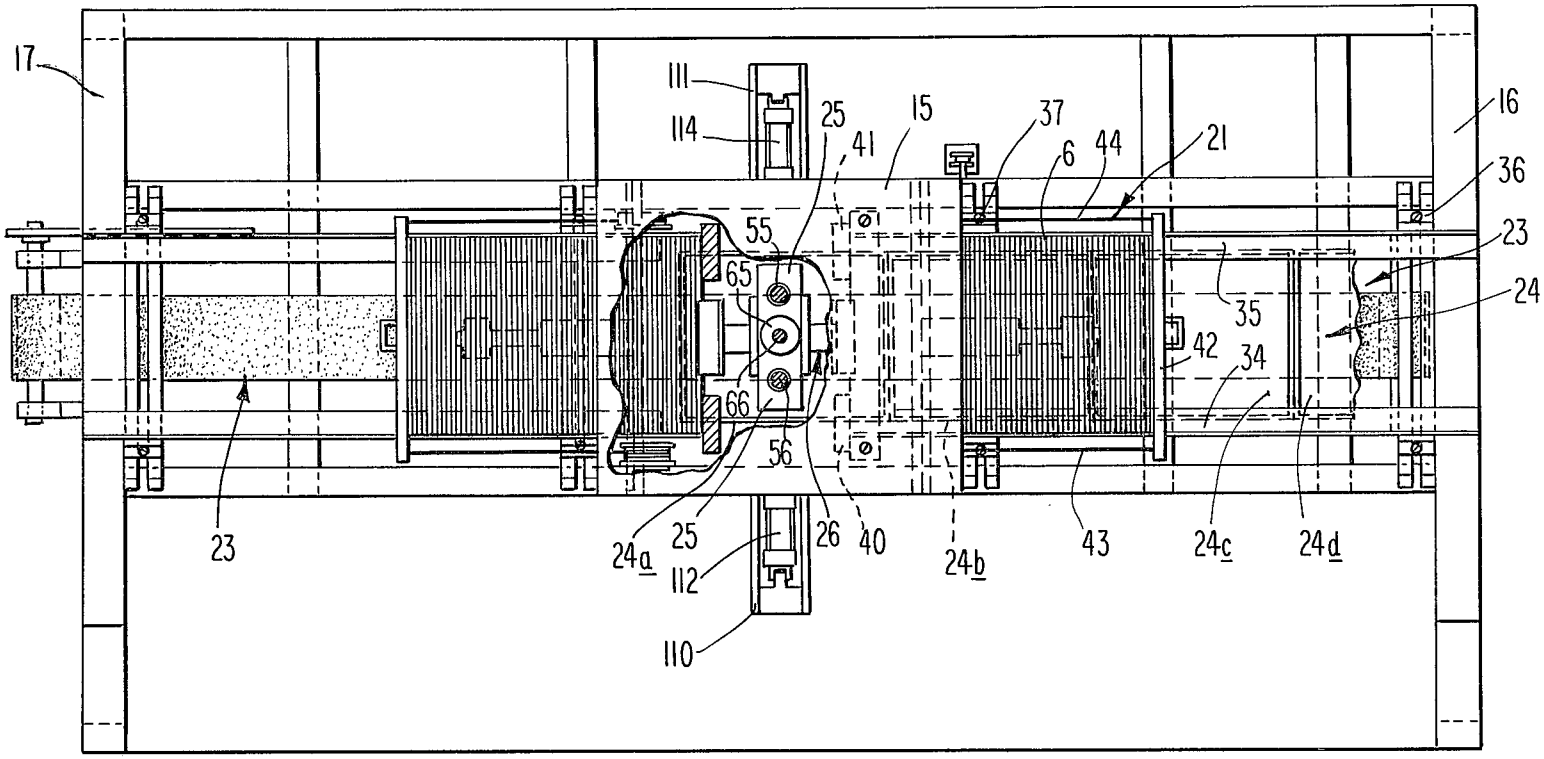
FIG. 2 is a plan view of the machine of FIG. 1.
Figure 3:
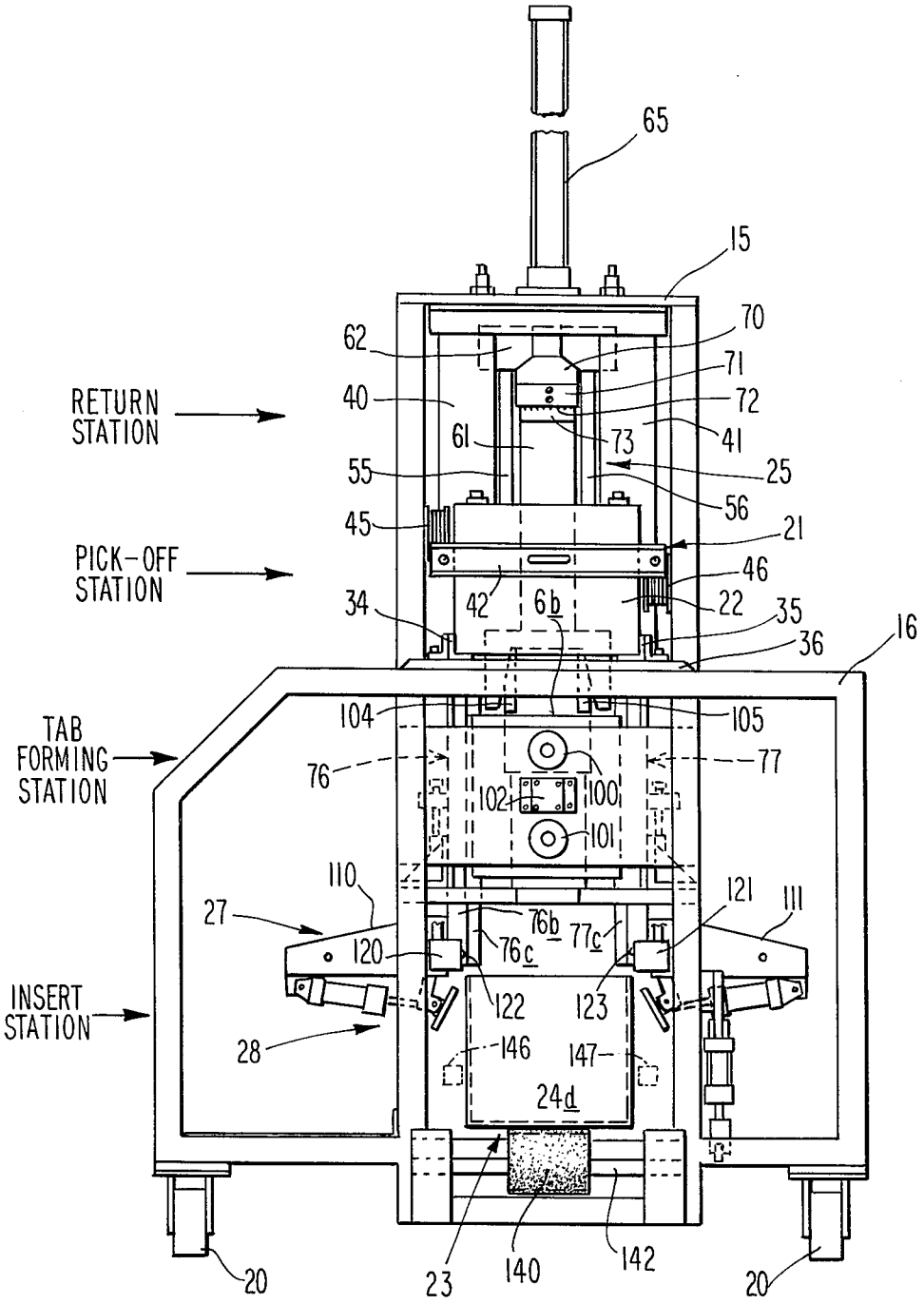
FIG. 3 is a side view looking to the left in FIG. 1.

Referring to FIGS. 1, 2 and 3 the machine supports its various components on the main frame 14 which includes center section 15 and left end section 17 and right end section 16. The main frame is preferably mounted on wheels 20. The Return, Pick-Off, Tab-Forming, and Insert Station areas of the machine are noted by the arrows.

A magazine 21 is mounted on end section 16 and carries a stack 22 of the dividers 6.

A carton transporter 23 is mounted on the bottom of the frame sections 15, 16 and 17. The carton transporter 23 delivers the cartons 24 from the right to the Insert Station at the center of the machine for the assembly operation and then removes carton/divider assemblies out towards the left.

A divider transporter 25 is mounted on the center section 15. The divider transporter 25 reciprocates in a vertical direction on the center section 15 and functions to move dividers from the magazine 21 to the Tab Forming Station and to move tab formed dividers from the Tab Forming Station to the Insert Station.

Tab forming punch and die means 26 at the Tab Forming Station is carried by center section 15. The punch and die means receives a divider from the magazine and forms the tabs.

Adhesive applying mechanism 27 and pressure applying mechanism 28 are located at the bottom of the frame 15 and operate in the Insert Station.

The details of the machine will be described by first explaining the structure and function of the above mentioned major components and then afterwards explaining the sequence of operations of these components in acheiving the objective of taking cartons and dividers and automatically assembling together at high rates of speed.

For ease of description, please not the following labeling arrangement:

The numeral 6 designating the right hand divider in FIG. 20 has been employed in conjunction with a lower case letter for each divider shown at the various stations as follows: the lead divider in the magazine *6a;* the divider received in the Tab Forming Station as *6b;* the tab formed divider in the Tab Forming Station as *6c;* the divider being moved between the Tab Forming Station and the Insert Station as *6d;* and the divider in the Insert Station *6e*. The latter divider *6e* corresponds to divider 6 of FIG. 20. Also, the letters $t_1$ and $t_2$ have been used to represent the tabs of the divider *6c; 6d* and *6e*. These latter tabs correspond to the tabs 10 and 11 of FIG. 20. With respect to the cartons 24, the lead carton in the insert station has been labeled *24a* and follower cartons labeled *24b* etc.

MAGAZINE

The magazine accepts the stack of dividers 6 and moves the stack so that one after the other the dividers are placed into the Pick-Off Station.

On the end frame 16 are a pair of angles 34 and 35 which respectively receive the lower edges of the dividers 6 so that the stack is aligned along a horizontal axis. The angles 34 and 35 are connected to slotted cross pieces 36 and 37 disposed on the frame 16 which allow the angles to be adjusted toward one another to accommodate different size dividers. The angles form tracks for the dividers.

The forward end of the magazine has a pair of spaced pick-off plates 40 and 41 which are connected to the center section 15. The forward divider *6a* abuts the pick-off plates 40 and 41 and in such condition is in the Pick-Off Station. The plates 40 and 41 are wide enough to accommodate any size divider accommodated by the angles 34 and 35.

The rear most divider is engaged by a pressure bar 42. The bar is pulled forward by the cables 43 and 44 which are held under tension by negator springs in the housing 45 and 46. Th force of the pressure bar urges the stack toward the pick-off plates. The force is of a magnitude so that the forward divider *6a* is releasably held against the plates and can be moved down away from the stack.

For loading a new stack the pressure bar 42 is held in the keeper 47 (shown in FIG. 1 only) while the dividers are put in place on the angles 34 and 35.

A pair of support fingers 50 and 51 form extensions of the horizontal sections of the tracks 34 and 35 (see FIGS. 8 and 13) are mounted on the frame 15 so as to be adjustable toward and away from the pick-off plates 40 and 41.

Vertical spaces 52 and 53 (FIG. 13) are formed between the ends of the support fingers 50 and 51 and the pick-off plates 40 and 41. The vertical spaces provide clearance for a divider to be moved down between the pick-off plates and the ends of the fingers; i.e. downwardly from the Pick-Off Station.

With reference to FIG. 8, it will be seen that the top surface of the finger 50 is substantially flush with the bottom surface of the angle 35. The top surface of finger 51 is similarly disposed. This provides clearance 54 for finger 50 and a similar clearance for finger 51. These clearances allow the first few carton in the stack the opportunity to slide down on the fingers 50 and 51. The purpose is to help break the contact with the stack so as to aid the Pick-Off operation. If necessary the fingers 50 and 51 can be adjusted toward the pick-off plates 40 and 41 so that the clearance is sufficient for only one divider and thus insuring that only one divider at a time can be moved from the Pick-Off Station.

DIVIDER TRANSPORTER

The divider transporter 25 moves dividers from the Pick-Off Station to the Tab Forming Station and moves tab-formed dividers from the latter station to the Insert Station. A description of the structure and operation of the divider transporter follows:

Referring to FIGS. 4–8 the divider transporter 25 is in the Return Station or at the top most part of the machine.

A pair of guide rods 55 and 56 are fixedly connected at their respective top and bottom ends to the center section 15. A transporter frame 57 including the plates 60 and 61 joined by cross pieces 62, 63 and 64 (see particularly FIG. 8) is slidably mounted on the guide rods by bushings on the guide rods.

A cylinder 65 is secured to the center frame 15 the piston rod 66 of which is joined to the top cross piece 62. The piston moves the transporter frame up and down the guide rods under the control of the cylinder.

At its top end, the divider transporter mounts pick-off means 67 and at its lower end mounts the divider gripper means 68. In the Return Station the pick-off means 67 is positioned above the magazine 21 and the gripper means 68 is positioned just above the tab forming punch and die means 26.

Referring to FIGS. 4 thru 10, the divider transporter 25 is moved from the Return Station down to the Pick-Off station so that the pick-off means 67 strips a divider from the magazine and then continues on to the Tab Forming Station to deposit stripped divider **6*b* in the die means 26. The gripper means 68 on the divider transporter is moved from its position above the punch and die means 26 (FIG. 4) down thru the die where it grips a tab-formed divider and moves same to the Insert Station (FIG. 6) to insert the divider 6*e* in the carton 24*a*** for the joining operation.

PICK-OFF MEANS

When the divider transporter is moved down from the Return Station into and thru the Pick-Off Station, the pick-off means 67 operates to engage and strip a divider from the stack and push the divider down into the Tab Forming Station.

The pick-off means 67 includes bracket 70 connected to the transporter frame 57 and mounting a finger plate 71 which carries stabilizing fingers 72 together with a blade 73 (see FIGS. 4 and 8). The plate 71 and blade 73 (and fingers 72) extend normal to the magazine axis.

As the transporter approaches the Pick-Off Station the blade 73, which is angled to the vertical, contacts the top edge of the forward divider **6*a* (FIG. 11) and as the blade continues moving the angled orientation tends to push the forward divider 6*a* back away from the pick-off plates 40 and 41. With continued motion the stabilizing fingers 72 enter the top edge of the divider 6*a*. Also, the bottom of the plate 71 engages the top edge and begins to push the divider down thru the spaces 52 and 53 between the pick-off plates and the support fingers 50 and 51**.

The plate 71 is dimensioned and set up so that the plate 71 does not engage the next adjacent divider as it strips away the divider **6*a***. A few thousandths of an inch clearance is sufficient.

The pick-off means 67, moves the stripped divider into the punch and die means 26 in the Tab Forming Station as explained below. Incidently, the gripper means 68 mentioned above will be explained after the description of the punch and die means 26 because the gripper functions after the die means 26 has formed the tabs.

TAB FORMING PUNCH & DIE

In connection with the description of the tab forming punch and die means 26 and the various parts thereof as indicated on the drawings, it will be helpful to observe that the plan view in FIG. 14 indicates the approximate section where FIGS. 8, 9 and 10 have been taken and also indicates the approximate section where FIGS. 4, 5 and 6 have been taken.

Referring to FIGS. 9 and 14, the tab forming punch and die means 26 has a divider receiving section comprising the props 74 and 75 and a tab forming section which includes die structures 76 and 77 and punch means 78.

When the divider transporter 25 moves the divider into the Tab Forming Station, the divider is received by the supports 74 and 75. This positions the divider between the die structures 76 and 77 and the punch 78.

The vertically extending dies 76 and 77 are respectively comprised of corresponding die sections **76*a*–77*a*, 76*b*–77*b*, and 76*c* and 77*c*. These die sections are tied together by top bars 80 and 81 and by the lower bars 82 and 83. The lower bars carry adjusting screws 84 and 85 threaded into the nut blocks 86 and 87 on the die brackets 90 and 91 fixed to the frame 15. The screws 84 and 85 together with the screws 92 and 93 (disposed within the slots in the die brackets 90 and 91) secure the die sections to the frame 15**.

The die sections have correspondingly contoured surfaces; namely round surfaces or bending sections $d_1$–$d_2$, slanted surfaces $d_3$–$d_4$ and flat surfaces $d_5$–$d_6$. The surfaces extend downwardly and are open at the lower extremities to provide for the exit of a divider after the tabs are formed. The lower extremities of section $d_3$ and $d_4$ have cam surfaces $d_3'$ and $d_4'$. The purpose of the cam surfaces is to bend the tabs during the insert/gluing processes as will be noted later.

The punch means 78 has a punch plate 95 carried by the rods 96 and 97 slidably mounted in the bearings 98 and 99 which are fixed to the frame 15. The rods carry the buffers 100 and 101. A cylinder 102 is fixed to the frame 15 and carries a piston the rod 103 of which is connected to plate 95. The cylinder controls the back and fourth motion of the plate means 95. The plate means 95 is adapted to engage a divider in the Tab Forming Station and push the same into dies 76 and 77 to form tabs.

The tab forming operation will be described particularly with reference to FIGS. 14 and 15.

Referring to FIGS. 9 and 14, the pick-off means 67 remains engaged with the top of the divider **6*b* in the receiving section until just prior to the tab forming operation. At that time the divider transporter backs-off to the Return Station so that the pick-off means is out of contact with the divider 6*b*. Incidently, the stabilizing fingers 72** disengage without disturbing the divider since they do make a nail-like engagement.

With regard to the pick-off means 67 moving back up thru the Pick-Off Station, it will be noted that the bracket 70 has a slanted surface **71*a*. This allows the pick-off means to slide past the lead divider without disturbing the same by that the surface 71*a* simply pushes the dividers back from the pick-off plates 40 and 41. The action is similar to the action of blade 73**.

With the pick-off means 67 disengaged from the divider **6*b*, the punch plate 95 is moved to the left and the divider 6*b* is moved against the round surfaces $d_1$ and $d_2$. This bends the outer vertical edges of the divider backward and has the effect of fracturing the cardboard to the extent of substantially reducing the memory of the material. This partially forms the tabs. The fracture forms the innermost part of the tab. With continued motion to the left (see FIGS. 10 and 15) the punch plate 95 moves the partially formed tabs into engagement with the slanted surfaces $d_3$ and $d_4$ and the divider body itself into engagement with the flat surfaces $d_5$ and $d_6$. This completes the tab forming operation as noted by divider 6*c*. After the tabs have been formed, the punch plate moves away. The tab formed divider remains stationary in the dies 76 and 77 ready to be moved by the gripper means 68 out of the dies 76 and 77** and down into the Insert Station.

GRIPPER MEANS

The gripper means 68 includes a pair of flexible fingers 104 and 105 which are capable of sliding over the tab-formed divider and pressing the same against the side plate **61*a* of the transporter plate 61**. This is accomplished as follows:

After the tabs have been formed, the divider transporter 25 is moved down from the Return Station. The pick-off means 67 operates as described above (FIG. 9). Also, the gripper means 88 functions to move the tab-formed divider out of the dies 76 and 77. When the divider transporter moves the gripper down from the position of FIG. 10 lower ends of the fingers 104 and 105 contact the upper edge of the divider 6c and begin to move the same down. The tabs $t_1$ and $t_2$ start to engage the cam surfaces $d_3'$ and $d_4'$ (FIG. 5) and this causes the tabs to bend inwardly at approximately 90°. Consequently, the divider resists movement and the fingers 104 and 105 slide over the divider to their fullest extent. When the divider transporter is at its furthermost down position, the divider is fully inserted in the carton (see FIGS. 6 and 9) at the Insert Station.

At the Insert Station, the adhesive applying mechanism 27 and the pressure applying mechanism 28 comprise means to separate each tab and its associated panel, means to apply adhesive to each tab as the divider is being inserted and means to apply pressure to the tab and panel so the adhesive effectively joins the same together. These elements are described following.

SEPARATOR

The separator means comprises the cam surfaces $d_3'$ and $d_4'$ together with a pair of panel spreaders 106 and 107. The action of the cam surfaces to bend the tabs inwardly has been explained above. The action of the spreaders will be explained particularly with reference to FIGS. 4, 5 and 6.

The lower ends of the dies 76 and 77 respectively carry the brackets 110 and 111. The spreader 106 is pivotally connected to the bracket 110 and the spreader 107 is pivotally connected to the bracket 111. The bracket 110 carries a cylinder 112 the piston rod 113 of which is pivotally connected to the spreader 106. The bracket 111 carries cylinder 114 the piston rod 115 of which is pivotally connected to the spreader 107.

When the divider 6c is in the tab forming dies 76 and 77, the piston rods 113 and 115 are moved to rotate the spreaders inwardly to the inoperative position indicated in FIGS. 4 and 6. Before the divider transporter begins to move the divider downwardly the piston rods 113 and 115 are moved to pull the spreaders outwardly. The bottom of each spreader contacts the tops of panels 116 and 117 of the carton 24a and pulls the same outwardly as noted in FIG. 5.

Thus, by the action of the cam surfaces $d_3'/d_4'$ and the spreaders 106/107 the tabs and panels are substantially separated as the divider is inserted into the carton so that the tabs and panels are out of contact. The separation is to permit the divider to be inserted without the adhesive being wiped off. The adhesive applicators are noted following.

ADHESIVE APPLICATORS

The relationship between the tabs and the adhesive applicators for applying the glue or adhesive while the divider is being inserted is best shown in FIG. 5A.

The brackets 110 and 111 respectively carry applicators 120 and 121 which have the nozzles 122 and 123. These nozzles are directed so that as the tabs $t_1$ and $t_2$ move downwardly the adhesive is being sprayed over the full length of each tab. The width of the adhesive will normally extend almost over the full width of the tab and one of the vertical edges of the adhesive should be close to the tab bend area. The applicators 120 and 121 are conventional and supplied with adhesive from a source not shown.

After the adhesive is applied and the divider is fully inserted, the spreaders 106 and 107 are pivoted away to the position of FIG. 6. This allows the panels 116 and 117 to snap back to the normal upright position against the tabs. Pressure is then applied to each tab and its panels as described below.

PRESSURE MEANS

The pressure applying means includes pressure pads on the divider transporter to engage the tabs and pressure plates on the frame to engage the panels whereby each tab and its panel are squeezed together as described below.

The divider transporter 25 carries a pair of pressure pads 124 and 125. As noted in FIGS. 5 and 6 these pads are adapted to engage the inside surfaces of the tabs $t_1$ and $t_2$.

A pair of pressure plates 126 and 127 are pivotally connected to the links 130 and 131 which are in turn pivotally connected to the brackets 110 and 111. (As noted in FIG. 7, the plates 126 and 127 are aligned respectively with the tabs 124 and 125). The bracket 110 mounts the cylinder 132, the piston rod 133 of which is pivoted to link 130 and plate 126. The bracket 111 mounts the cylinder 134, the piston rod 135 of which is pivotally connected to the link 131 and the plate 127.

The inoperative position of the plates 126 and 127 is shown in FIGS. 4 and 5 wherein the plates are spaced away from the panels 116 and 117. For the pressure applying operation, the piston rods 133 and 135 move the plates up against the panels 116 and 117 as indicated in FIGS. 6 and 7.

After the adhesive has been set, the pressure plates 126 and 127 are moved away to the inoperative position and the divider transporter starts to move upwardly. The gripper means is disengaging from the divider and the transporter moves then on up to the Return Station. The assembled carton and divider at the insert station is now ready to be released to the carton transporter and moved out of the machine.

CARTON TRANSPORTER

The carton transporter 23 will be described particularly in connection with FIGS. 16–19.

In general, the carton transporter comprises a belt means 140 which transports raw cartons into the machine and assembled cartons/dividers out of the machine together with a carton positioner/release means 141 which properly positions and holds a carton for the insert operation and then releases the same to the belt.

The cartons are fed to the belt means 140 one after the other preferably by conventional automatic equipment not shown. The belt means 140 is continuously moving. The positioner 141 maintains the lead carton 24a fixed in the Insert Station. The lead carton causes the other cartons to stack up one behind the other as indicated at 24b, 24c, and 24d. After the dividers are secured to the lead carton 24a the positioner 141 releases the same to the belt which moves the assembled carton/divider out of the machine. When the lead carton 24a is released the belt moves next adjacent carton 24b into the insert station.

The belt means 140 is a conventional conveyor type fabric belt mounted on roller means 142 and 143 (FIG. 1) rotatably supported on the frame sections 16 and 17. A conventional drive system including motor 144 continuously rotates the belt. Carton guide means in the form of rails 146 and 147 properly maintains the cartons on the belt for delivery to the positioner 141. The rails 146 and 147 are shown only in FIG. 3 for purposes of clarity. The rails are disposed substantially above the surface of the belt and extend substantially over the length of belt 140. The rails can be moved transversely to accommodate a different size carton. The supporting and adjusting means for the rails will be discussed later.

The positioner 141 includes the arms 150 and 151 connected to a rocker bar 152 pivotally connected to the center frame 15. A cylinder 153, the piston rod 154 of which is connected to the rocker bar 152 rocks the bar back and forth as between a "hold" position (FIG. 17) to a "release" position (FIG. 18).

On the left hand end of each bar is a stop as indicated at 155 and 156. In the hold position, the stops are adapted to engage the bottom corner of the lead carton 24*a* and position the lead carton in the Insert Station. The presence of the carton 24*a* in the Insert Station is detected by the sensor (electric eye) LS-10 (FIG. 1).

In the release position, the stops 155 and 156 are moved away from the assembled carton/divider (FIG. 18) so that the belt can move the carton to the left out of the machine. The condition of the moving assembly being sufficiently downstream from the stops 155/156 so the same can be moved to "hold" is detected by the sensor LS-11 (note FIG. 19). Sensor LS-11 is also an electric eye.

The right hand section of each arm is configured (see section 157 for arm 150) so that as the arms are moved to the release position the next carton (24*b*) is raised away from the belt and the ends of the arms (see end 158) engage the next carton (24*c*) to prevent the same being moved by the belt.

After release of the assembled carton/divider the arms 150 and 151 return to the hold position (FIG. 19). The effect of this is to allow the carton 24*b* to engage the belt which then moves along to engage the stops 155 and 156. The end 158 moves away from the next carton 24*c* so that the carton and the cartons following are moved to the left by the belt, against the carton 24*b* held by the stops 155 and 156.

SEQUENCE OF OPERATIONS

The sequence of operations will be explained by first describing the assembly of the initial carton/divider and then the manner in which the second carton/divider is readied for assembly. Once the latter is accomplished, the machine simply repeats the cycle over and over again.

In outlining the sequence of operations, reference will be made to several of the Figures previously described particularly with respect to the position of the machine component referred to. While several FIGS. show the same position, the Figure (or Figures) referred to will be the one most clearly illustrating the components. Also it will be understood that the Figure referred to will not necessarily illustrate the operative condition of the machine at the time in question.

The sequence is summarized or outlined in steps (1) thru (14) following:

(1) Divider Transporter 25 in Return Station (a) Pick-off at top of machine (FIGS. 1, 8)

(b) Gripper 68 disposed just above forming section 26*b* of punch and die means 26 (FIGS. 8 and 15).

(2) Carton Transporter 23 in Hold (a) First carton 24*a* positioned in Insert Station (FIGS. 1, 8, 17)

(3) Magazine 21 Loaded (a) First divider 6*a* at Pick-Off Station (FIGS. 1, 8)

(4) Punch & Die Means 26 Inactive (a) There is no divider in the receiving section 26*a* nor in the die section 26*b*.

(b) The punch means 78 is retracted (FIGS 8, 14).

(5) Divider Transporter 25 Moved Down For Pick-Off and Gripper (a) Pick-Off 67 engages first divider 6*a* (FIG. 9) strips same out of magazine and deposits on props 74 and 75 in the receiving section 26*a* of the punch and die means 26 (FIGS. 8, 14). The divider on the props is indicated at 6*b*.

(b) Gripper 68 does not grip a divider at this time because (as noted in (4) above) there is no divider in the forming section 26*b* of the punch and die means 26.

(6) Divider Transporter 25 Moves Up To Return Station (a) Pick-Off 67 returns to top of machine. (FIGS. 1 and 8)

(b) Gripper 68 assumes position above forming section 26*b* of the punch and die means 26 (FIG. 8).

(7) Punch & Die Operates (a) After the divider transporter is in Return Station, the punch means 78 operates. The plate 95 pushes the first divider 6*b* into the receiving section 26*c* (FIGS. 10, 15). The punch means then immediately returns the plate 95 to retracted position (FIGS. 8, 14).

(8) Divider Transporter Moves Down for Second Pick-Off & Gripper Operations.

(a) Gripper 68 engages divider 6*c* in section 26*b* of die 26 and pushes same down out die for in sertion in carton; tabs bent 90° (FIGS. 5 and 5A).

(9) Spreaders 106 and 107 Operate (a) As the gripper 68 starts to move the divider 6*c* down, the spreaders pull back the carton panels (FIGS. 5 and 5A).

(10) Adhesive Applicators 120 and 121 Operate (a) When the lower edge of the divider is just below the level of the applicators 120 and 121, the same operate to spray adhesive on the tabs. This continues until the divider is almost fully inserted in the carton.

(11) Spreaders 106 and 107 Operate (a) When the carton is fully inserted (see 6*e* in FIG. 6) the spreaders 106 and 107 disengage from carton panels so the panels snap back to engage tabs.

(12) Pressure Mechanism Operates (a) Pressure pads 124 and 125 on the divider transporter 25 are in position behind the tabs (FIG. 7) and the outside pressure plates 126 and 127 are moved to engage the panels to squeeze tabs and panels together (FIG. 6) and then after a short dwell move away from panels (as in FIGS. 3 and 5).

(13) Divider Transporter Moves Toward Return Station (a) Gripper 68 starts to disengage from divider 6*e*.

(14) Carton Transporter Operates (a) As the divider transporter is moving up, the stops 155 and 156 are moved to release position (FIG. 18) to release the assembled carton/divider. End 158 temporarily holds oncoming carton 24*b*.

(b) After the assembled carton/divider moves away from the insert station the stops 155 and 156 are moved to the hold position and a new carton 24*b* is deposited in the Insert Station (FIG. 19). This latter operation is completed just before the divider transporter reaches the Return Station.

(15) Repeat (a) Steps (7) thru (14) repeated.

CARTON POSITIONER/RELEASE

FIGS. 21, 22, and 23 illustrate a carton positioner/-release mechanism 159 which positions and releases cartons at a faster rate than the positioner/release mechanism 141. Thus, in instances where higher production rates are required the mechanism of FIGS. 21–23 is employed. The mechanism 159 will be described following a description of the carton guide rails and the adjusting means for same.

The carton guide rails 160 and 161 extend over the length of the belt 140 down close to the same (FIG. 23) and except for a cut-out section 160*a* are the same as the rails 146 and 147. The means for adjusting the rails toward and away from one another to accommodate different size cartons is the same for both the rails 146/147 and for rails 160/161 except the components which accommodate the different vertical locations with respect to the belt as will be noted shortly. The adjusting mechanism will next be described.

On the underside of the left frame section 17 are mounted a pair of journals 162 and 163. The journals mount the threaded shaft 164 so that the shaft can rotate without moving axially.

On the underside of the right frame section 16 are mounted a pair of journals 164 and 166, which mount the threaded shaft 167 for rotation without axial motion.

The threaded shafts 164 and 167 mount the sprokets 170 and 171 which carry the chain 172. The shaft 164 has a handle 173. When the handle is turned the shafts 164 and 167 will rotate in unison and in the same direction.

The shaft 164 carries a pair of nuts 174 and 175 and the shaft 167 carries a pair of nuts 176 and 177. The threads on the shafts 164 and 167 which mount the nuts 174 and 176 are of one hand and the threads mounting the nuts 175 and 177 are of the opposite hand. The nuts 174 and 176 mount the carton guide rail 160 while the nuts 176 and 177 mount the carton guide rail 161.

With the above structure, rotation of the shaft handle 173 will cause the rails 160 and 161 to be spaced from one another a distance to accommodate the size of the cartons being processed. The spacing will be symmetrical with respect to the axis of the belt 140.

Essentially the same adjusting mechanism is employed for the rails 146 and 147. The primary difference being that the nuts mounting the rails 146 and 147 are at a greater vertical height than the nuts 174–177 mounting the rails 160 and 161. The greater vertical height is necessary to provide operating space for the arms 150/151 and the stops 155/156 of the positioner/release mechanism 141.

The carton positioner/release mechanism 159 will now be described.

The mechanism 159 has a head 180 which reciprocates back and forth between a "hold" position indicated by the full lines in FIGS. 21 and 22 and a "release" position indicated by the dotted lines in FIG. 22.

The head is moved by the double acting cylinder 181, the piston rod 182 of which is connected to the head through a guide (not shown) which prevents turning of the piston. The cylinder is supported on a bracket 183 mounted on the rail 161.

Referring to FIG. 21, the head 180 is in the "hold" position wherein it projects into the path of the oncoming cartons 24*d*, 24*e*, etc. The carton 24*d* is held in the Insert Station by the head for receiving one or more dividers as explained above. The sensor LS-10′ senses the presence of the carton in the Insert Station. The sensor LS-10′ is identical to the sensor LS-10 mentioned heretofore.

After assembly, the head is moved to the "release" position and this frees the assembled carton/divider to be moved forward by the belt 140. When the front end of the assembled carton/divider 24*f* reaches the axial position of the sensor LS-11′ (same as sensor LS-11) the cylinder 181 is activated to move the head 180 to the hold position. As the head moves to the "hold" position it contacts the side of the assembled carton/divider 24*f* and knocks the same laterally as noted in FIG. 22. This movement is accommodated by the cut-out section 160*a*. The action does not disturb the ability of the belt 140 to continue to move the carton forward as noted by dotted lines 24*g*.

As the head 180 is moved into the "hold" position, it is projected into the path of the carbon 24*e* and when the carton engages the head it is stopped in the Insert Position.

ELECTRO-PNEUMATIC CIRCUITS

A typical system for operating the various cylinder means which cause operation of the components as mentioned heretofore will be noted below in connection with FIGS. 24 and 25. FIG. 24 diagrammatically illustrates a typical pneumatic circuit while FIG. 25 diagrammatically illustrates a typical electric circuit.

In FIG. 24, the various air cylinders are supplied by conventional solenoid operated valves which are spring biased in one direction and electrically biased in the opposite direction. The valves are connected to air supply line 184.

The divider transporter cylinder 65 is supplied by the valve A under the control of the solenoid A. The spreader cylinders 112 and 114 are supplied thru the valve B under the control of the solenoid B. The pressure mechanism cylinders 132 and 134 are supplied thru the valve C under the control of the solenoid C. The carton positioner/release cylinder 153 (FIG. 1) is supplied by the valve D under control of the solenoid D. When the arrangement of FIGS. 21–23 is employed, the cylinder 181 is substituted for the cylinder 153.

The punch cylinder 102 is supplied by the valve E under the control of the solenoid E. The adhesive mechanisms 120 and 121 are supplied by the valve F under the control of the solenoid F. The mechanisms 120 and 121 are spring biased to the "off" position and are air biased to the "on" or spray position.

The solenoid A-F are energized and de-energized by certain timer contacts and by one or more series connected cam actuated limit switches mounted on the machine. The location of the switches of the machine are indicated in FIGS. 1 and 4.

Referring to FIG. 4 the switches LS-1 and LS-6 are mounted at the top of the frame 14 and are actuated by cam means (not shown) on the top cross piece 62 of the divider transporter. The upward orientation of each of the switch arms indicates that the switches are operated when the divider transporter moves in the up direction and is in the Return Station.

The switches LS-5 and LS-9 are located on the frame 14 underneath the above mentioned switches. The switch LS-9 is actuated by the same cam means on cross piece 62 (which actuates switches LS-1 and LS-6) as the divider transporter moves in the down direction toward the FIG. 5. The switch LS-5 is actuated by the same cam means on the cross piece 62 (which actuates switches LS-1, LS-6 and LS-9) when the divider transporter is moving up toward the return station approximately when the gripper means 68 has just cleared the top of the divider glued in the carton.

The switch LS-4 below the switch LS-5 is actuated by the cam means on the top cross piece 62 when the divider transporter is moved down into the Insert Station.

Referring to FIG. 1, the switch LS-2 is mounted on the right hand frame section 16 so as to be actuated by the end of rod 97 of the punch means when the rod is moved toward the right or into the retracted position. Incidentally, it is to be noted that when both sides of the machine are used a switch similar to LS-2 is mounted to be actuated when the left side punch means is in the retracted condition.

The electric eye sensors LS-10, LS-11, LS-10' and LS-11' have light beam receivers (not shown). The interruption of the respective beams by the cartons actuate the sensor contacts.

It will be understood that the limit switches LS-1 etc. are the conventional and commercially available type. The operating arms of limit switches LS-1 etc are spring biased in one direction to effect opening or closing of the switch contacts and the arms are moved by contact with the cams on the divider transporter in the opposite direction to effect opening or closing of the switch contacts.

In FIG. 25, the contacts for the above mentioned switches have corresponding letter/number designations followed by a lower case letter.

Referring to FIG. 25 assume: that the main switch 185 and the belt motor switch 186 both have been closed; that the machiene has previously been set up and completed a couple of carton/divider assemblies; that the divider transporter 25 is in the Return Station; that the punch 78 is in the retracted position; and that the positioner release mechanism 141 is employed and is holding a carton 24*a* in the Insert Station.

When the divider/transporter 25 is in the Return Station one of the cams actuates the switch LS-1 so that the contacts LS-1-*a* are closed. The contacts LS-2*a* also are closed by the punch 78 in the retracted position. The presence of the carton 24*a* in the Insert Station is detected by the sensor LS-10 which closes the contact LS-10*a* (and LS-10*b*). Thus solenoid A and the relay R are energized.

The solenoid A operates the valve A to cause the divider/transporter 25 to start downward movement. The solenoid A has a holding circuit including timer contacts TR-1 and relay contacts R-1. When the relay R is energized the contacts R-1 close to complete the holding circuit.

As the divider/transporter 25 leaves the Return Station the switch contacts LS-1*a* open but the solenoid is held up thru the holding circuit.

The closure of the contacts LS-10*b* energizes the solenoid B and this causes the valve B to operate the spreaders 106 and 107 to pull the carton panels 116 and 117 outwardly.

As the divider/transporter moves down to a position wherein the tab-formed divider 6*d* (being pushed from the die by the gripper means 68) is just entering the carton, then one of the cams actuates the switch LS-9 which closes contacts LS-9*a*. This energizes the solenoid F which in turn causes the applicators 120 and 121 to start spraying adhesive on the tabs. The cam actuating the switch LS-9 is axially elongated so that it continues to engage the switch to maintain the adhesive spray as the divider is moved into the carton. When the switch LS-9 and cam disengage the adhesive is shut off as noted below.

As the divider transporter is moving down, it will be recalled, that the pick-off means 67 is functioning to strip a divider from the magazine 21 and deposit the same in the receiving section 26*a* of the die means 26.

Just before the divider reaches the bottom of the carton, the switch LS-9 and its cam disengage. The contacts LS-9*a* open to stop the application of the adhesive.

When the divider is pushed all the way to the bottom of the carton, the cams actuate the switch LS-4 which opens the contacts LS-4*a* and closes contacts LS-4*b*.

When the contacts LS-4*a* open the spreader solenoid B de-energizes and valve B functions to cause the spreaders 106 and 107 to release the carton panels so that they snap back against the tabs.

When the LS-4*b* contacts close, the solenoid C and the timer TR are energized. When the solenoid C is energized the valve C causes the pressure mechanism 28 to press the tabs and panels together.

The timer TR controls the time period over which pressure is held on the tabs and carton panels. Normally this is the order of a fraction of a second. At the end of the specified time, the timer contacts TR-1 and TR-2 open.

The opening of the TR-2 contacts de-energizes the solenoid C and the valve C releases the holding pressure on the tabs and panels. The opening of the TR-1 contacts opens the holding circuit for solenoid A and the valve A starts the divider/transporter 25 in its return stroke.

When the divider/transporter 25 reaches an upward position wherein the gripper means 68 is free from the carton/divider assembly, one of the cams actuates the switch LS-5. This closes the contacts LS-5*a* which energizes the solenoid D and the valve D functions to release the carton/divider assembly (stops 155, 156 move down). The belt then moves the assembly until the leading edge of the carton is detected by the sensor LS-11 and the contacts LS-11*a* are opened. This de-energizes the solenoid D and the valve D causes the positioner/release mechanism to move to the hold position (stops 155–156 move up).

It will be understood, of course, that when the positioner/release mechanism of FIG. 21 is employed the sensors LS-10′ and LS-11′ (with corresponding contacts LS-10*a*′, LS-10*b*′, and LS-11*a*′) function as just described to control the divider transporter 25, the spreader 106 and 107 and the position/release mechanism head 180. Before the divider/transporter is fully in the Return Position one of the cams actuates the switch LS-6 which closes the contacts LS-6*a* and solenoid E is energized, so that the valve E causes the punch 78 to move the divider for the tab-forming operation.

With forward movement of the punch 78, the switch LS-2 is actuated and the contacts LS-2*a* are opened. This opens the solenoid circuit so that the transporter divider 25 can not move down while the punch is operating. The cam actuating the switch LS-6 is elongated to the extent to allow the punch to move forward to form the tabs and then immediately retract.

By the time the punch 78 has retracted to close the LS-2*a* contacts the divider/transporter 25 is fully in the Return Station. The switch LS-1 is actuated to close the LS-1*a* contact. When the new carton arrives in the Insert Station, the sensor LS-10 is actuated and this closes the LS-10*a* contacts and the cycle is started again.

The above described pneumatic/electro/mechanical system for moving the various machine components is representative of various of such conventional systems. Moreover it will be understood that conventional solid state systems may be employed on the machine.

Before closing an example of the advantage of the machine in turning out high strength cartons is commented on.

The high strength cartons are responsible for substantial savings in storage and in transportation costs due to the increase in the number of loaded cartons that can be stacked without crushing the bottom carton.

For example, bottlers of soft drinks in half-gallon/-two liter containers normally employ, for shipping purposes, a four panel slotted carton without top flaps and having an H-type insert which divides the carton into 2 spaces each retaining three bottles. The carton size is approximately 9″×14″×12″.

For storage, the cartons are stacked in layers on pallets or skids. The stack is limited to 5 layers as otherwise the weight will crush the bottom carton. For shipping, the pallet is picked up by a lift fork and moved into a trailer. With the 5 stack arrangement there is a substantial space between the top of the trailer and the top layer of the stack. Obviously, this wastes space and the bottler, in essence, is shipping air.

By using the cartons of the invention, the layers can be increased from 5 to 7. For shipping, the pallet is moved into the trailer. The top layer of the stack is just slightly below the top of the trailer. This space is utilized. There is no shipping of air.

Thus, it will be apparent that with the cartons of the invention there is a 40% increase in both storage and shipping volume with consequent cost savings.

We claim:

1. In a machine for fixedly joining a four panel, open, fully erected and complete carton and a carton divider:

a magazine supporting a stack of dividers arranged one beside the other along a first axis, the magazine including means to move the dividers one after another to a pick-off station and releasably retain the divider in the pick-off station;

a divider transporter mounted for reciprocating motion along a second axis transverse said first axis in a working stroke serially along said second axis from a return station, to said pick-off station, to a tab forming station, to an insert station and thence in a return stroke to the return station;

a carton transporter for supporting a plurality of four panel, open, fully erected and complete cartons and delivering the cartons one by one to said insert station, maintaining a carton in the insert station for a divider insertion and joining operation and removing a joined divider and carton from said insert station;

pick-off means on said divider transporter to engage a divider in the pick-off station and move the divider to the tab forming station;

means in said tab forming station to receive a divider from said pick-off station and form tabs on two opposite edges of the divider;

gripper means on said divider transporter to engage said formed divider in the tab forming station and move the divider out of the tab forming station into a carton maintained in the insert station with the tabs located respectively adjacent a pair of opposite panels of the carton; and means in said insert station to apply adhesive between said tab and its panel and to press the tab and panel together after insertion to provide for said adhesive to securely join the same together.

2. The machine of claim 1 wherein said magazine comprises:

a pair of spaced apart angle means extending parallel one another along a horizontal axis, each to be engaged by the lower corner of the dividers in said stack;

a pair of vertical extending, spaced apart pick-off plates disposed at corresponding ends of the angle means to be engaged by the forward divider of said stack whereby to establish said pick-off station.

3. The machine of claim 2 wherein said means to move the stack of dividers includes a pressure bar to engage the rearmost divider in the stack and spring biased cable means connected to the bar and to urge the bar toward said pick-off plates.

4. The machine of claim 1 further including a pair of vertically extending pick-off plates in said pick-off station to be engaged by the lead divider of said stack and wherein said divider transporter is mounted so that said second axis is a vertical axis and wherein said pick-off means includes a pick-off blade extending in a direction generally normal to said first axis and angularly oriented with respect to the vertical whereby the blade will engage the top edge of said lead divider in the pick-off station and move the divider away from the pick-off plates to facilitate removal of the divider from the pick-off station and the pick-off means further including a plurality of fingers to project into the top edge of a divider in the pick-off station for moving the divider out of the magazine into the tab forming station.

5. The machine of claim 4 wherein said divider transporter includes:

a pair of vertically extending guide rods;

a transporter frame slidably mounted on said guide rods;

cylinder/piston means, the piston rod of which being connected to the transporter frame for moving the same along said guide rods;

a top cross piece adjacent the top of said frame;

said pick-off means being connected to said cross piece;

yieldable, downwardly extending finger means mounted on said transporter frame and adapted to slide over and yieldably hold a divider against the transporter frame, the finger means comprising said gripper means; and a pair of pressure pads mounted on said transporter frame and operative at said insert station for respectively engaging the inside surface of a divider tab for use in pressing the tab and the panel together, said pressure pads comprising in part said means to press tab and panel together.

6. The machine of claim 1 wherein said carton transporter comprises:

belt means for said delivering and removing of cartons;

cradle means to receive a carton from the belt means and hold the same in the insert station and then release the carton for removal; and guide means to maintain the cartons on the belt means.

7. The machine of claim 6 wherein said cradle means comprises:

a pair of arms fixedly connected together and respectively disposed on opposite sides of and below said belt means;

means disposed intermediate the ends of the arms and mounting the arms for rocking motion as between a hold position and a release position;

stop means respectively adjacent one end of the arms configured to receive and hold a carton when the arms are in the hold position and to be located below the belt means away from the cartons when the arms are in the release position, the opposite ends of the arms being configured to lift a carton away from the belt means and engage the next adjacaent carton to prevent motion of the oncoming cartons when the arms are in the release position; and piston/cylinder means to move said arm between the hold and release positions.

8. The machine of claim 1 wherein said means in the tab forming station includes tab forming punch and die means, support means to receive a divider from the pick-off station and support the same between said punch and die means, the punch means being adapted to engage the divider and push the same into the die means to form tabs on opposite edges and then move away from the formed divider, the die means releasably holding the divider in position.

9. The machine of claim 8 wherein:

said tab forming die means comprises a pair of bending sections to engage and bend the opposite edges of the divider to fracture the divider and define the innermost part of the tab when the divider is pushed past the bending sections by the punch means and a pair of slanted sections to receive and engage said bent edges and form the same into said tabs when the punch means pushes the divider fully into the die;

said punch means comprises a slidably mounted plate and cylinder/piston means, the piston rod of which is connected to said plate for moving the same; and said divider support means comprises finger means to support and position the divider between said die means and said punch plate.

10. In the machine for fixedly joining a four panel, open, fully erected and complete carton and a carton divider:

a magazine supporting a stack of dividers arranged one beside the other along a first axis, the magazine including means to move the dividers one after another to a pick-off station and releasably retain the divider in the pick-off station;

a divider transporter mounted for reciprocating motion along a second axis transverse said first axis in a working stroke serially along said second axis from a return station, to said pick-off station, to a tab forming station, to an insert station and thence in a return stroke to the return station;

a carton transporter for supporting a plurality of four panel, open, fully erected and complete cartons and delivering the cartons one by one to said insert station, maintaining a carton in the insert station for a divider insertion and joining operation and removing a joined divider and carton from said insert station;

pick-off means on said divider transporter to engage a divider in the pick-off station and move the divider to the tab forming station;

means in said tab forming station to receive a divider from said pick-off station and form tabs on two opposite edges of the divider;

gripper means on said divider transporter to engage said formed divider in the tab forming station and move the divider out of the tab forming station into a carton maintained in the insert station with the tabs located respectively adjacent a pair of opposite panels of the carton; and means in said insert station to securely join each tab and its panel together.

11. The machine of claim 10 wherein last said means applies adhesive between each tab and its panel to securely join the same together.

12. In a machine for fixedly joining a four panel, open, fully erected and complete carton and a carton divider:

a magazine supporting a stack of dividers arranged one beside the other along a first axis, the magazine including means to move the dividers one after another to a pick-off station and releasably retain the divider in the pick-off station;

a divider transporter mounted for reciprocating motion along a second axis transverse said first axis in a working stroke serially along said second axis from a return station, to said pick-off station, to a tab forming station, to an insert station and thence in a return stroke to the return station;

a carton transporter for supporting a plurality of four panel, open, fully erected and complete cartons and delivering the cartons one by one to said insert station, maintaining a carton in the insert station for a divider insertion and joining operation and removing a joined divider and carton from said insert station;

pick-off means on said divider transporter to engage a divider in the pick-off station and move the divider to the tab forming station;

means in said tab forming station to receive a divider from said pick-off station and form tabs on two opposite edges of the divider;

gripper means on said divider transporter to engage said formed divider in the tab forming station and move the divider out of the tab forming station into a carton maintained in the insert station with the tabs located respectively adjacent a pair of opposite panels of the carton;

mechanism to effect separation of each tab and its panel while the divider is being inserted in the carton;

mechanism to apply adhesive to each tab as the divider is being inserted; and means to press each tab and its panel together after insertion to provide for said adhesive to securely join the same together.

13. The machine of claim 12 wherein said means in the tab forming station includes tab forming punch and die means, support means to receive a divider from the pick-off station and support the same between said punch and die means, the punch means being adapted to engage the divider and push the same into the die means to form tabs on opposite edges and then move away from the formed divider, the die means releasably holding the divider in position.

14. The machine of claim 13 wherein said separator mechanism includes:

a pair of cam surfaces located below the tab forming section of the tab forming die means to respectively receive and inwardly bend the tabs as the divider is moved from the tab forming station to the insert station; and a pair of spreaders disposed below said cam surfaces and each respectively adapted to engage a carton panel and pull the same outwardly.

15. The machine of claim 14 wherein said means to press each tab and its panel together comprises:

a pair of pressure pads mounted on said divider transporter and operative at said insert station for respectively engaging the inside surface of a divider tab; and a pair of pressure plates to respectively engage the outside surface of said opposite panels of the carton when in the insert station, each pressure pad and the corresponding pressure plates when engaged pressing the tab and panel together.

* * * * *